United States Patent [19]

Andrews

[11] Patent Number: 4,920,335

[45] Date of Patent: Apr. 24, 1990

[54] ELECTRONIC ARTICLE SURVEILLANCE DEVICE WITH REMOTE DEACTIVATION

[75] Inventor: George F. Andrews, Cocoa, Fla.

[73] Assignee: Interamerican Industrial Company, Miami, Fla.

[21] Appl. No.: 304,202

[22] Filed: Jan. 31, 1989

[51] Int. Cl.[5] ..... G08B 13/24

[52] U.S. Cl. ..... 340/572

[58] Field of Search ..... 340/572

[56] References Cited

U.S. PATENT DOCUMENTS

| | | | |
|---|---|---|---|
| 3,500,373 | 3/1970 | Minasy | 340/572 |
| 3,624,631 | 11/1971 | Chomet et al. | 340/572 |
| 3,810,147 | 5/1974 | Lichtblau | 340/572 |
| 3,938,044 | 2/1976 | Lichtblau | 340/572 |
| 4,745,401 | 5/1988 | Montean | 340/572 |
| 4,778,552 | 10/1988 | Benge et al. | 340/572 |
| 4,835,524 | 5/1989 | Lamond et al. | 340/572 |

*Primary Examiner*—Glen R. Swann, III

*Attorney, Agent, or Firm*—Pettis & McDonald

[57] ABSTRACT

An improved electronic article surveillance device of the type utilized a parallel resonant circuit and primarily intended for use in tagging retail items for the purpose of preventing unauthorized removal of theft of such items includes, within the parallel resonant circuit, at least one transmission line resonator whereby the device may be easily and efficiently deactivated. The length of the transmission line resonator is one-quarter wave length of the deactivation frequency, and deactivation frequency is preferably selected from readily available electromagnetic radiation such as, for example, microwave energy or police radar energy.

7 Claims, 1 Drawing Sheet

ELECTRONIC ARTICLE SURVEILLANCE DEVICE WITH REMOTE DEACTIVATION

049200355 BACKGROUND OF THE INVENTION

1. Field of the Invention

The improved electronic article surveillance device of this invention may be generically referred to as a security tag used by retailers to prevent unauthorized removal or theft of consumer products. The electronic article surveillance device is constructed so that it may be easily attached to virtually any consumer product and is characterized by its electronic structure comprising deactivation means whereby the device may be rendered inoperative easily and efficiently without offending the customer, delaying check-out lines, or damaging the product. As described more completely hereinafter, it is the deactivation means of this device which I believe render it unique when compared with currently available such devices.

2. Description of the Prior Art

Shoplifting presently costs retailers billions of dollars annually, and is widely recognized as a pervasive and growing problem. Various techniques have been developed in the past for monitoring checkpoints, such as the exits of stores, in order to prevent the unauthorized taking of articles of merchandise out of the store or other protected areas. Some of these techniques utilize radiating electromagnetic energy which is reflected, absorbed or otherwise transformed by miniature electronic circuits embedded in or otherwise affixed to the protected articles. Many such systems have been developed wherein the circuits to be attached to the protected articles comprise only a small piece of metal of a special size and shape to form a resonant circuit. In such systems, a transmitter operates substantially continuously in the vicinity of the checkpoint at the resonant frequency of the circuits attached to the merchandise. When an article of merchandise bearing such circuit passes through the checkpoint, the circuit begins to resonate as a result of the transmitted energy, and this will result in actuation of an audible and/or visible alarm.

Of course, once a consumer item has been purchased, it is necessary either to remove or disarm the security tag so that the merchandise can be removed from the retail facility. This problem has, of course, been recognized in the prior art, and prior patent literature presents numerous examples of such security systems. For example, U.S. Pat. No. 3,500,373, describes and claims a method and apparatus for article theft detection utilizing principles of resonant circuits. However, this patent discloses no specific means for disarming the security tag, necessarily requiring removal of the tag at the point of purchase.

U.S. Pat. No. 3,624,631 discloses and claims a pilferage control system wherein a passive tuned circuit actuates the alarm. To preclude actuation of the alarm by tags on legitimately purchased merchandise, each passive tuned circuit of the '631 system is provided with a fusible link which is opened when the circuit is exposed to energy above a preselected level. Thus, upon legitimate purchase of a security tagged article, the tuned circuit is deactivated by exposing the security tag to sufficient electromagnetic energy to destroy the fusible link. In effect, this patent teaches "overloading" the circuit to achieve the desired fracture. It seems quite apparent that in order to insure deactivation of such a security tag not only would relatively high energy levels be required, but also there might even be a chance of damaging the merchandise during the deactivation process.

U.S. Pat. No. 3,810,147 discloses yet another electronic security system utilizing multi-frequency resonant tag circuits having distinct frequencies for detection and for deactivation. In other words, a second frequency is applied to the tag for the purpose of disarming it by rupturing a fusible link. This destroys the resonant properties of the tag at the detection frequency so that a deactivated tag produces no alarm when passing through a controlled area. However, in order to preclude inadvertent disarming of the tag, the fusible link of the '147 system requires relatively large power levels of the deactivating frequency, which not only increases the cost of such a system, but also may result in damage to the article carrying the security tag.

Other examples of the current state of the art for similar electronic article surveillance devices may be found in the following U.S. Letters Patent:

| | |
|---|---|
| U.S. Pat. No. | 3,863,244 |
| | 3,913,219 |
| | 3,967,161 |
| | 4,021,705 |
| | 4,498,076 |
| | 4,567,473, and |
| | 4,728,938. |

From a review of this prior patent literature, it can be seen that the use of parallel resonant circuits for security purposes is old and well known. Furthermore, the necessity of providing means within the circuit and/or external to the device for deactivating the device are also known. However, it can also be seen that, for the most part, in order to insure deactivation of a security tag upon legitimate purchase of the article, either the tag must be completely removed, or relatively high levels of electromagnetic radiation must be applied in close proximity to the security tag to insure its deactivation.

It is, therefore, clear that there remains a substantial need for an electronic article surveillance device wherein a deactivation means is provided so that the security tag is efficiently, economically and reliably deactivated without offending the customer, delaying check-out lines, or damaging the product to which the tag is attached.

SUMMARY OF THE INVENTION

The present invention relates to an improved electronic article surveillance system of the type employing a parallel resonant circuit designed to respond to a first frequency of transmitted electromagnetic radiation wherein the improvement comprises deactivation means incorporated into the parallel resonant circuit for disarming the device upon its exposure to a second frequency of electromagnetic radiation. As will be set forth in greater detail hereinafter, the design and construction of the deactivation means of this invention eliminates the necessity of removing the article surveillance device from the product and provides for deactivation in a non-offensive, nonproduct destructive, economical, reliable, and efficient manner. While an entire security system would necessarily involve a transmitter of a fixed frequency ($F_1$), as well as a second transmitter set on a different frequency ($F_2$), the scope of the present invention is specifically concerned with the electronic article surveillance device, or security tag itself.

The tags to be used are parallel resonant circuits comprising a coil and a capacitor, the coil consisting of a spiral configuration of squares and one plate of the capacitor on one surface of the substrate, and a connecting line in the other plate of the capacitor on the other surface of the substrate. By virtue of the manufacturing process utilized in forming the parallel resonant circuits, the electronic article surveillance device of this invention may be formed on virtually any substrate capable of providing a non-conductive barrier between the two surfaces on which the resonant circuits are printed. The hole through each device provides for completing the circuit from one surface to the other. I have also determined that the completed device may be provided with a protective coating to allow the device to function in what might be termed a "hostile" environment, to protect against oxidation, to be decorative and/or useful as a label for the merchandise, or even to protect from stains as in dry cleaning processes. Such final protective layers may be, for example, but not in limitation, tin, paper, polymers, or adhesives. None of these coatings would impair proper functioning of the device of this invention.

Deactivation of the electronic article surveillance device of this invention is accomplished by means of a transmission line resonator. Set into the coil portion of the circuit are two additional lines of circuitry which are exactly one-quarter wave length of a second frequency ($F_2$) which is different from the primary frequency ($F_1$). These two lines are substantially parallel and form a U-shaped circuit which is open at one end and closed (shorted) at the other end. Upon receipt of transmissions of frequency $F_2$, the induced voltage is at its maximum at the open end. Simultaneously, the maximum value of induced current occurs exactly at the shorted end of the "U" section, generating enough heat at that end to actually burn out that end of the transmission line resonator, breaking the coil to render the parallel resonant circuit inoperative at frequency $F_1$.

While a single transmission line resonator is sufficient, it has been determined that the use of a pair of transmission line resonators provides an extra measure of assurance in deactivating the circuit. As will be described with regard to a preferred embodiment, hereinafter, the second transmission line resonator may be placed on an opposite side of the security card substrate, and would preferably be disposed in orthogonal relation to the first transmission line resonator. By placing the two transmission line resonators at substantial right angles to each other, the deactivating frequency $F_2$ is more sure to be received whether the polarity of the $F_2$ transmission is either linear, i.e., vertical or horizontal, or circular.

It is to be noted that high energy levels for the frequency $F_2$ are not required, and the physical dimensions of the shorted end of the transmission line resonator may be predetermined with regard to width and thickness so as to result in substantially instantaneous vaporization of the "fuse" connection to the parallel resonant circuit without the generation of any significant heat.

It is to be understood that the frequency $F_2$ of the deactivation signal is selected such that the dimensions of the quarter-wave resonator are suitable for the desired physical size of the tag. Its parameters must also include the required peak power level and short duty cycle. I have determined that a preferred energy source would be at 2.45 GHz, a frequency widely used for microwave cooking since transmitting components are readily and economically available at this frequency. I have also determined that the transmitter emitting frequency $F_2$ to deactivate the device of this invention would, in quick succession emit a frequency $F_1$ in order to verify deactivation before the article was released to the customer.

The invention accordingly comprises an article of manufacture possessing the features, properties and the relation of elements which will be exemplified in the article hereinafter described, and the scope of the invention will be indicated in the claims.

BRIEF DESCRIPTION OF THE DRAWINGS

For a fuller understanding of the nature and objects of the invention, reference should be had to the following detailed description taken in connection with the accompanying drawings, in which.

Similar reference characters refer to similar parts throughout the several views of the drawings.

DETAILED DESCRIPTION

Figure 1:
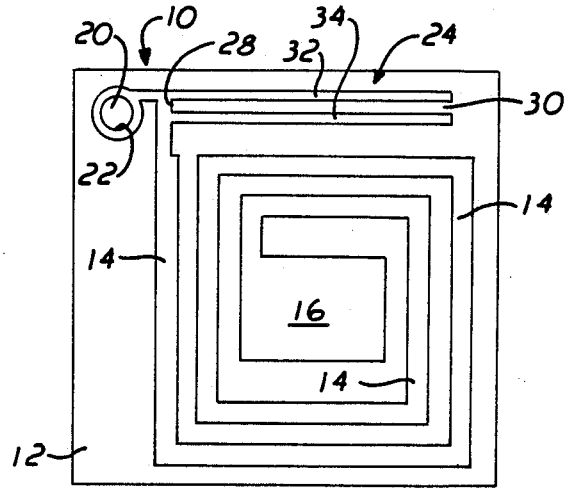
FIG. 1 is a top plan view of the electronic article surveillance device of this invention.

The electronic article surveillance device of the present invention is generally indicated as 10 in the drawings. It is, of course, to be understood that electronic article surveillance device 10 basically comprises a printed circuit, and the circuit components are provided on a substrate 12. As previously indicated, virtually any non-conductive material may be utilized for substrate 12 including, without limitation, polyurethane plastic, paper, or fabric.

A parallel resonant circuit is printed onto substrate 12 and comprises a coil 14 defined by a spiral configuration of squares and a first plate 16 of a capacitor on the top surface of substrate 12, and a second plate 18 of the capacitor on the bottom side of substrate 12. An aperture 20 is provided through substrate 12, and conductive material 22 encompasses aperture 20 to complete the circuit from the top to the bottom surface of substrate 12.

Figure 2:
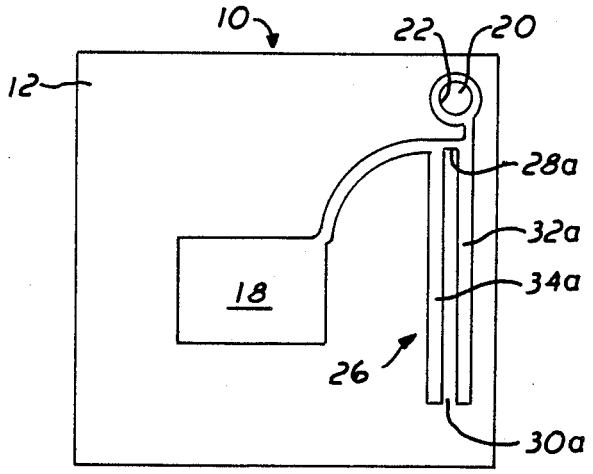
FIG. 2 is a bottom plan view thereof.

The deactivation means, as shown in the preferred embodiment of FIGS. 1 and 2, comprises a pair of transmission line resonators, with the transmission line resonator generally indicated as 24 being disposed on the top surface of substrate 12, and the transmission line resonator generally indicated as 26 being disposed on the bottom surface of substrate 12. As clearly seen in the views of FIGS. 1 and 2, both transmission line resonators 24 and 26 form elements of the parallel resonant circuit.

Each of the transmission line resonators 24 and 26 include a first end 28 and **28*a* which is shorted to the parallel resonant circuit, and a second open end 30 and 30*a*. The length defined by first ends 28 and 28*a* and second open ends 30 and 30*a* is one-quarter wave length of the deactivation frequency, $F_2$. Accordingly, when frequency $F_2$ is transmitted in the vicinity of device 10, shorted end 28 of at least one of the transmission line resonators 24 and 26 will burn out to disable device 10**.

Further details of the construction of the transmission line resonators 24 and 26 may be seen in the views of the drawings as comprising first and second resonator arms 32, **32*a* and 34, 34*a* respectively. First and second resonator arms 32 and 34 and 32***a* and 34*a* are parallel to each other and spaced apart one from the other. The length of each of the resonator arms 32, 32*a* and 34, 34*a* corresponds to the quarter wave length of the transmission line resonators 24 and 26.

It is also to be noted that in this preferred embodiment, the transmission line resonators 24 and 26 are disposed on the substrate 12 in orthogonal relation one to the other. While only a single such transmission line resonator would be sufficient for purposes of deactivating device 10, it has been determined that the use of a pair of resonators 24 and 26 as shown insures a deactivation response to frequency $F_2$ whether that frequency is linearly or circularly polarized. Obviously, then, though not deemed necessary for efficient and reliable operation, additional transmission line resonators could be utilized in the construction of device 10.

A primary advantage derived by the use of the unique deactivation means of this invention is that the transmission line resonators 24 and 26 may be constructed to respond to readily available electromagnetic radiation such as, for example, microwave energy or police radar energy. Unlike most prior art devices, high energy levels for deactivation are not required, and deactivation of the electronic article surveillance device 10 is accomplished with virtually no opportunity for damage to the article to which device 10 has been attached. Because it is not necessary to remove device 10 from the protected article, current circuit preparation techniques would actually permit incorporating the electronic article surveillance device 10 of this invention into a label permanently affixed to the protected article by the manufacturer. This would obviously reduce the cost of maintaining article security to the retail merchant. Deactivation could be quickly and easily accomplished at the point of sale without in any way compromising, for even a small period of time, system security at protected exits.

It is to be appreciated that the specific configuration and placement of the transmission line resonators of this invention may be varied dependent upon frequency $F_2$ and the overall size and configuration of the primary parallel resonant circuit. I have illustrated in the views of FIGS. 1 and 2 the best mode currently known to me for practicing this invention, but do not wish the scope of this invention to be limited thereto.

It will thus be seen that the objects set forth above, among those made apparent from the preceding description, are efficiently attained and, since certain changes may be made in the above article without departing from the scope of the invention, it is intended that all matter contained in the above description or shown in the accompanying drawings shall be interpreted as illustrative and not in a limiting sense.

It is also to be understood that the following claims are intended to cover all of the generic and specific features of the invention herein described, and all statements of the scope of the invention, which, as a matter of language, might be said to fall therebetween.

Now that the invention has been described,

What is claimed is:

1. In an electronic article surveillance device of the type employing a parallel resonant circuit designed to respond to a first frequency, $F_1$, of transmitted electromagnetic radiation; the improvement comprising deactivation means formed in the parallel resonant circuit, said deactivation means comprising a transmission line resonator having a first end shorted to the parallel resonant circuit and a second open end, said transmission line resonator having a length defined by said first and second ends and said length being substantially equal to one quarter of the wavelength of a second frequency, $F_2$, of transmitted electromagnetic radiation used to excite said transmission line resonator to interrupt the parallel resonant circuit at said first end of said transmission line resonator, whereby the electronic article surveillance device is deactivated.

2. An electronic article surveillance device as in claim 1 wherein said deactivation means comprise a plurality of said transmission line resonators, each of said transmission line resonators being formed in the parallel resonant circuit in orthogonal relation to another one of said transmission line resonators.

3. An electronic article surveillance device as in claim 1 wherein said deactivator means comprises a pair of said transmission line resonators formed in the parallel resonant circuit in orthogonal relation to each other.

4. An electronic article surveillance device as in claim 1 wherein said transmission line resonator comprises a first resonator arm and a second resonator arm substantially parallel thereto, each of said arms having a first arm end corresponding to said first end and having a second arm end corresponding to said second open end, whereby the length of each of said arms is defined by said transmission line resonator length, said first and second arms being spaced apart one from the other.

5. In an electronic article surveillance device of the type employing a parallel resonant circuit designed to respond to a first frequency, $F_1$, of transmitted electromagnetic radiation; the improvement comprising deactivation means formed in the parallel resonant circuit, said deactivation means comprising a plurality of transmission line resonators, each one of said transmission line resonators having a first end shorted to the parallel resonant circuit and a second open end, each one of said transmission line resonators having a length defined by said first: and second ends, and said length being substantially equal to one quarter of the wavelength of a second frequency, $F_2$, of transmitted electromagnetic radiation used to excite at least one of said transmission line resonators, whereby the electronic article surveillance system is deactivated by interrupting the parallel resonant circuit, each of said transmission line resonators being formed in the parallel resonant circuit in orthogonal relation to another one of said transmission line resonators.

6. An electronic article surveillance device as in claim 5 wherein said deactivator means comprises a pair of said transmission line resonators.

7. An electronic article surveillance device as in claim 5 wherein each one of said transmission line resonators comprises a first resonator arm and a second resonator arm substantially parallel thereto, each of said arms having a first arm end corresponding to said first end and having second arm end corresponding to said second open end, wherein the length of each of said arms is defined by said transmission line resonator length, said first and second arms being spaced apart one from the other.

* * * * *

UNITED STATES PATENT AND TRADEMARK OFFICE

CERTIFICATE OF CORRECTION

PATENT NO. : 4,920,335

DATED : APRIL 24, 1990

INVENTOR(S) : GEORGE F. ANDREWS

It is certified that error appears in the above-identified patent and that said Letters Patent are hereby corrected as shown below:

In the ABSTRACT:

Line 2, "utilized" should be "utilizing"

Line 4, the word "of" second occurrence, should be --or--

In the CLAIMS:

Column 6, line 42, the " : " should be deleted.

Signed and Sealed this

Twenty-third Day of July, 1991

*Attest:*

HARRY F. MANBECK, JR.

*Attesting Officer*

*Commissioner of Patents and Trademarks*